United States Patent [19]

Härle

[11] 4,237,549

[45] Dec. 2, 1980

[54] METRONOME

[75] Inventor: Friedrich Härle, Isny-Neutrauchburg, Fed. Rep. of Germany

[73] Assignee: Rudolf Wittner GmbH u. Co., Isny, Fed. Rep. of Germany

[21] Appl. No.: 920,124

[22] Filed: Jun. 28, 1978

[30] Foreign Application Priority Data

Jul. 11, 1977 [DE] Fed. Rep. of Germany ..... 2731210

[51] Int. Cl.[3] ..... G04B 15/00; G10B 15/00

[52] U.S. Cl. ..... 368/134; 84/484

[58] Field of Search ..... 58/130 R, 130 A, 130 C, 58/130 E; 84/484

[56] References Cited

FOREIGN PATENT DOCUMENTS 46506 4/1889 Fed. Rep. of Germany ..... 58/130

349478 11/1960 Switzerland ..... 58/130 A

*Primary Examiner*—Vit W. Miska

*Attorney, Agent, or Firm*—Lawrence E. Laubscher

[57] ABSTRACT

A metronome is disclosed including a casing accommodating a driving device for a pendulum, the casing having an elongate trough-like body covered by a cover plate. The driving device is mounted on the inside of the cover plate. An imprinted scale plate associated with the pendulum is mounted on the outside of the cover plate. The pendulum is fixed on a shaft mounted in a bridge on the cover plate and driven by the driving device. Two screws fix both the bridge and a frame of the driving device to the cover plate. Holders integrally formed on the inside of the cover plate, at a location spaced above the fixing screws, engage with and retain the frame of the driving device. The scale plate can thus present a wide uninterrupted surface on which tempi and beat rates can be imprinted and related to each other.

18 Claims, 7 Drawing Figures

120
118
100
102
98
16
40
10
34
42
92
26
12
32
24
44
30
28
46
46
112
110
47
45
22
58
114
14
116
36
118
48
48'

METRONOME

BRIEF DESCRIPTION OF THE PRIOR ART

The invention relates to a metronome of the kind with a casing which accommodates the driving device of a pendulum and which is formed by an elongate trough-like main portion and a cover plate covering the open side thereof, the driving device being fixed to the inside of the cover plate by means of at least two screws, and the pendulum and an imprinted scale plate associated therewith being arranged on the outside of the plate, wherein the pendulum is mounted in a U-shaped pendulum bridge which extends transversely to the longitudinal direction of the cover plate and which is retained on the cover plate by means of screws which serve at the same time for fixing the driving device.

In the known metronomes of this kind the driving device is usually retained on the inside of the cover plate by means of four fixing screws. As stated above, two fixing screws serve in this case for retaining the pendulum bridge, whereas the two other fixing screws are provided at a spacing above the pendulum bridge. Owing to the constructional size of the driving device the latter screws are located in a region in which the selectable musical tempi (time measures) are listed on the cover plate.

This placing of the fixing screws does not permit a relatively wide, closed scale plate to be attached to the outside of the cover plate, on which scale plate the beat rates or the numbers of audible beats per minute (for adjusting the displaceable pendulum weight) as well as the tempi associated with these numbers could have been recorded along the graduated scale; on the contrary, one is compelled to construct the scale plate as a relatively narrow strip and to fix it in the centre between the holes for the fixing screws in the cover plate. It therefore becomes necessary to imprint the tempi as well as the ranges of beat rates associated therewith on the outside of the cover plate on both sides of the scale plate, whereas only the beat rates can be printed on the scale plate. Thus both the scale plate and the cover plate have to be imprinted.

For the user of such a metronome, there is the substantial disadvantage that a direct adjustment of the pendulum weight to a desired tempo is impossible.

Namely, as explained already above, the various kinds of musical tempi as well as the beat rate ranges associated therewith, collected together in groups of beat rates, are recorded one below the other on the outside of the cover plate, namely outside the regions in which the various beat rates belonging to the various groups of beat rates are recorded on the scale plate. Therefore, when the user of such a metronome wishes to select a desired tempo, he first has to find where the respective beat rate group is recorded on the cover plate. Thereafter he has to take note of the appropriate statement relating to the group of beat rates corresponding to the selected tempo and has to look for it on the scale plate, before finally he can move the pendulum weight to a position which corresponds to one of these possible beat rates.

What is desired is a metronome constructed so that the selection of desired beat rates may be performed in a considerably simpler manner.

SUMMARY OF THE INVENTION

The present invention provides a metronome of the kind described, in which the driving device is retained at the inside of the cover plate at least at one location at a spacing from the fixing screws of the pendulum bridge by means of at least one holder member which is arranged at the cover plate and which engages in and/or engages over a component member of the driving device.

Thus, in this case, merely the fixing screws which are necessary for the arrangement of the pendulum bridge serve also for the mounting of the driving device, which, in order to ensure perfect retention thereof at the inside of the cover plate, is held thereon by means of at least one further additional holder which is formed preferably directly on the inside of the cover plate. Thereby the arrangement of the two additional fixing screws usually provided above and at a spacing from the pendulum bridge may be omitted, so that it is possible to extend the scale plate in toto widthwise as well as lengthwise over the regions in which normally the fixing screws are located. The enlargement of the scale plate which has thus become possible offers then the considerable advantage that the statements about the selectable tempi associated with the individual groups of beat rates may be listed adjacent these beat rates, so that direct adjustment of the pendulum weight to a given tempo is possible.

Finally, owing to the construction according to the invention, the assembly of the driving device is considerably facilitated in as much as the driving device, before it is to be screwed to the cover plate by means of the two fixing screws retaining the pendulum bridge, need only be brought into operative connection with the holder provided on the inside of the cover plate, and thus the attachment of a further pair of screws may be omitted.

If, in a known manner, the driving device comprises a frame which is U-shaped in cross-section and the limbs of which are cranked outwardly in the edge region, wherein in each cranked edge portion in the region adjacent one of its ends a respective screw-threaded bore for one of the fixing screws is arranged, a favourable construction is obtained if at least one of the cranked edge portions is associated with a said holder, which engages with a region of the said portion remote from its screw-threaded bore.

It is advantageous in this case to arrange the construction so that the frame of the driving device, during assembly, may be located in a perfect mounting position, by providing a recess in the said edge portion between the screw-threaded bore and the holder, in which a pin on the inside of the cover plate engages.

A particularly simple construction of the holder is in the form of a rail having a lip-like projection which engages substantially without play over the corresponding cranked edge portion. In this case, during the assembly of the driving device, first a limb edge portion of the frame must be pushed under the rail, whereafter the frame limb is located on the cover plate by means of the pin engaging in the recess, and finally the fixing screws are attached with the simultaneous fixing of the pendulum bridge.

In a preferred constructional embodiment the two cranked edge portions are each retained on the cover plate by means of a holder whose lip-like projection extends between two abutments on the cover plate, between which the end of the respective edge portion remote from the screw-threaded bore engages.

A further simplification of the assembly is obtained if the pendulum bridge has feet which each engage positively in a recess in the cover plate, since in this case the pendulum bridge can be placed in a perfectly flush position in relation to the opening present in the cover plate for the passage therethrough of the pendulum shaft, without a time-consuming adjustment procedure being necessary. A bearing bore in the bridge (for the pendulum shaft) is preferably conically enlarged at the front end, the bridge terminating at a spacing from the front end of the conically enlarged bearing bore, thus ensuring that the shaft is protected against contact.

It is furthermore advantageous if, for the purpose of fixing the cover plate to the main portion of the casing, two screw holes are provided in the cover plate in alignment with the fixing screws, at a lateral spacing from the fixing screws, so that in the region of the scale plate which has a comparatively large width, no fixing screws are required for securely connecting the cover plate to the main portion of the casing.

Stable mounting of the cover plate on the main portion of the casing is ensured by making them mutually positively engageable, by means of a peripheral collar on one engaging with the other, and by making them mutually lockable by detent means.

BRIEF DESCRIPTION OF THE DRAWING

The invention will be described further, by way of example only, with reference to the accompanying drawings, in which.

DETAILED DESCRIPTION

Figure 1:
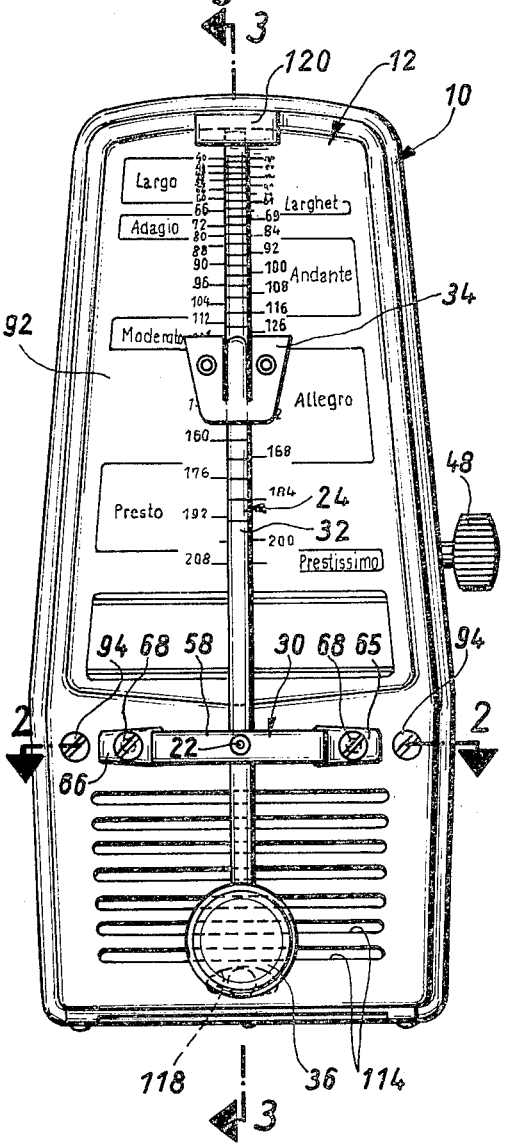
FIG. 1 is a front view of a metronome (with the lid omitted)

The metronome shown comprises a casing which is formed by an elongate trough-like main portion 10 and a cover plate 12 which covers the open side thereof, and which in turn may be covered by a lid 14 when the metronome is not in use.

The inside of the cover plate 12 is provided with a driving device 16 by means of which rythmic beats may be produced, the beat rate being adjustable in a known manner by means of a pendulum 24 which is non-rotatably mounted on a pendulum shaft 22. For this purpose, the shaft 22 is rotatably mounted at its one end in a frame 26 of the driving device 16 and penetrates through an opening 28 of the cover plate 12; its end portion which penetrates through the cover plate 12 is rotatably and axially displaceably mounted in a pendulum bridge 30. The pendulum 24 is located on the shaft 22 between the plate 12 and the bridge 30. It comprises a resiliently elastic pendulum rod 32 and a pendulum weight 34 which is displaceable and retainable at predetermined locations along the portion of the rod 32 which extends upwardly from the shaft 22. A balance weight 36 is fixed to the portion of the rod 32 which extends downwardly from the shaft 22.

The driving device 16 comprises in a known manner a spring shaft 42 which supports a spring housing 38 with a spring housing wheel 40, and which drives a beat gear wheel 44 whose teeth 46 co-operate with two armature pallets 45,47 on the pendulum shaft 22 for the purpose of producing rhythmic beats. The spring of the driving device 17 may be wound by means of a key 48.

Figure 2:
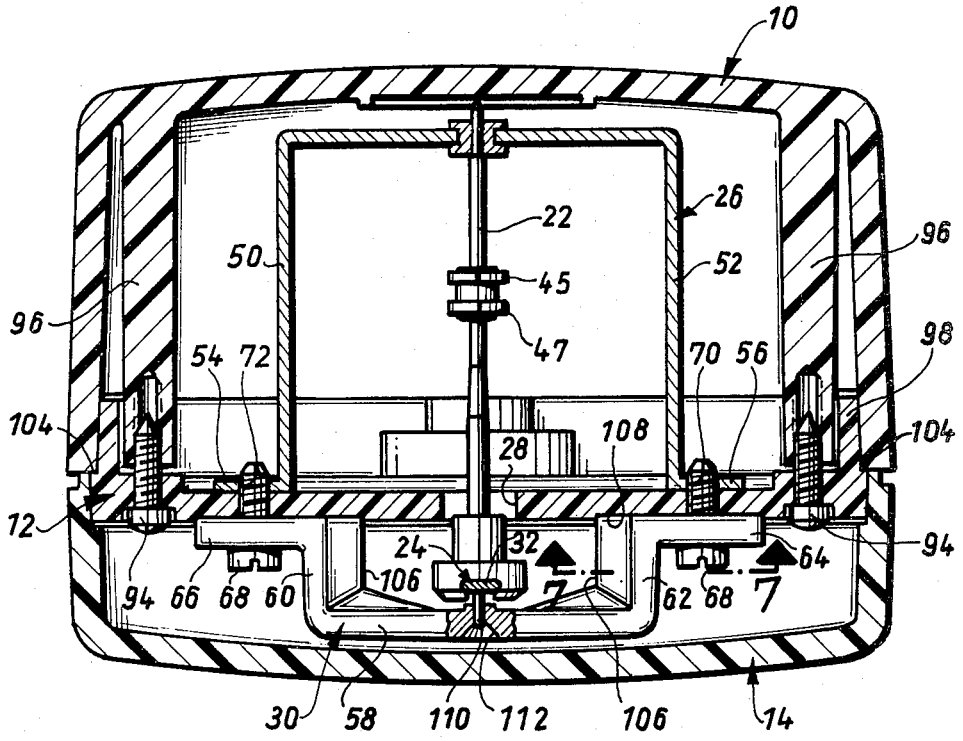
FIG. 2 is a cross-section on line 2—2 of FIG. 1.

As illustrated in FIG. 2, the frame 26 of the driving device is of U-shaped construction in cross-section and the two limbs 50,52 thereof comprise edge portions 54 and 56, respectively, which are cranked outwardly at right angles.

In a known manner, the pendulum bridge 30 is of U-shaped construction and its limbs 60,62, which are connected together by means of a connecting rail 58 forming the bearing body for the pendulum shaft 22, comprise feet 64 and 66, respectively, which project outwardly at right angles to the limbs and each of which receives a fixing screw 68 for fixing the pendulum bridge. These screws 68 penetrate the cover plate 12 and are screwed into screw-threaded bores 70 and 72, respectively, of the edge portions 54,56 of the frame 26. In this way both the pendulum bridge 30 and the frame 26 of the driving device can be fixed to the cover plate by means of these two fixing screws. The construction of the driving device 16 as well as that of the pendulum are known per se.

In order that the two fixing screws 68 may be sufficient for mounting the driving device 16 on the cover plate 12, two holders 74, 76 are provided on the inside of the cover plate 12 at a lateral spacing from each other and above the level at which the screws 68 are located; the holders are preferably of rail-like construction and extend in the longitudinal direction of the edge portions 54, 56. In the illustrated constructional example, the holders 74, 76 are each provided with a lip 78 at their end which faces the frame 26 of the driving device; the lips 78 are located at a spacing from the inner surface of the cover plate 12 and engage over the edge portions 54, 56 from the upper end thereof in such a manner that each edge portion engages positively in a groove-like recess 80 defined by the lip 78 and the inside of the cover plate 12. Thus the holders 74, 76 securely retain the upper part of the frame 26 against the inside of the cover plate, so that there a corresponding arrangement of fixing screws in the cover plate can be omitted. On both sides of the holders 74, 76 a respective pair of abutments 82, 84 is located which receive between them the respective end part of the edge portions 54, 56 and align it accurately.

Figure 6:
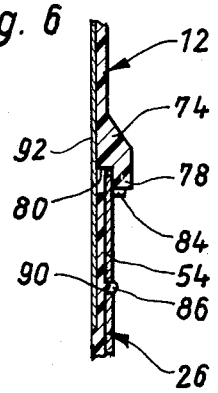
FIG. 6 is a partial section on line 6—6 of FIG. 4.

The cover plate 12 is preferably formed by a one-piece moulded member consisting of synthetic resin and having the holders 74, 76 as well as the lateral abutments 82, 84 formed thereon. Moreover, for the purpose of accurately locating the driving device on the cover plate, a cylindrical pin 86 or 88, respectively, also formed on the cover plate is provided for each edge portion 54 and 56, respectively, of the frame 26, the pin engaging positively in a respective recess 90 provided approximately in the longitudinal centre of the edge portion (see FIG. 6).

The above-described manner of fixing the upper frame portion on the inside of the cover plate by means of the holders 74, 76 permits the arrangement on the outside of the cover plate of a scale plate 92 which has a large width over its entire length and which is left free of bores for fixing screws, although a driving device of usual construction is being employed (for whose fixing normally another pair of fixing screws would be provided in a plane above the pendulum bridge, so that the scale plate would have to be interrupted in these regions). Owing to the fact that, in accordance with the invention, the manner of fixing of the driving device permits the omission of a further pair of fixing screws and thus allows the scale plate to be of relatively wide construction, a completely novel distribution of the visual indications necessary for adjusting the metronome is possible on the scale plate, namely in such a manner that the beat rate group prescribed for an individual tempo can be grouped together thereon by a bracket and also the tempo can itself be stated within this bracket. The possibility of such a configuration of the scale plate thus permits the desired beat rate to be selected at a glance from a beat rate group associated with a tempo chosen from a number of common tempo, as illustrated in FIG. 1.

A further feature allowing the scale plate 92 to be made continuous with a relatively large width and thereby to be able to imprint completely thereon the beat rate groups and other indications, without this imprint being interrupted by fixing screws, is that for the purpose of attaching the cover plate 12 to the open side of the main portion 10 of the casing, only two fixing screws 94 are provided, which are located at the level of the pendulum bridge 30 at a lateral spacing from the fixing screws 68. These fixing screws 94 are screwable into columns 96 which are formed on the bottom of the main portion 10 of the casing and thereby produce a secure connection between the cover plate 12 and the main portion 10.

Figure 4:
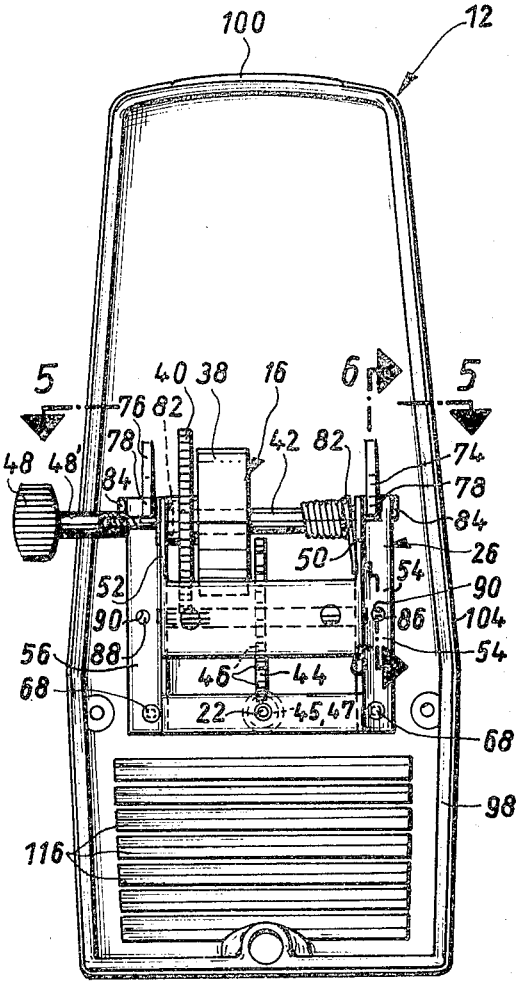
FIG. 4 is a rear view of the frontal cover plate of the metronome casing, with associated parts.
Figure 5:
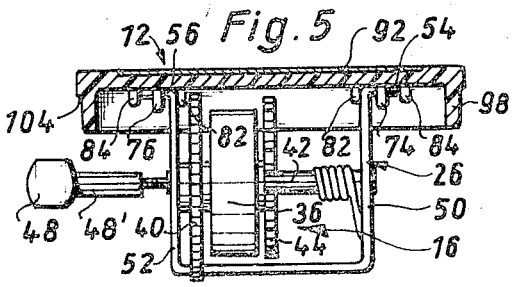
FIG. 5 is a cross-section on line 5—5 of FIG. 4.

In order to obtain in this way a reliable mutual connection of the parts 10, 12, a peripheral collar 98 is formed on the cover plate 12 and engages positively in the open side of the main portion 10 of the casing. According to FIGS. 3 and 4, a preferably rail-like detent lip 100 is formed on the upper portion of the collar 98 on the outside of the collar and is retainable in a detent depression 102 of the main portion 10 of the casing, and in this way a perfect mutual connection of these parts is ensured. The surrounding collar 98 of the cover plate comprises at its base an external shoulder 104 which, in the fixing position of the cover plate, lies upon the end face of the main portion 10 of the casing and thereby defines the assembly position of the cover plate.

Figure 7:
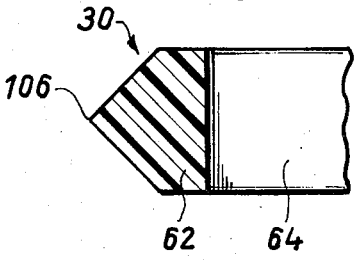
FIG. 7 is a partial section through the pendulum bridge on line 7—7 of FIG. 2.

The pendulum bridge 30 is formed by a moulded member which consists of a synthetic resin, in particular an acetal resin. The limbs 60, 62 are of right-angled triangular or gable-like cross-section at the inside, as illustrated in FIG. 7. The longitudinal edges 106 which in cross-section form apices of the triangles are directed towards each other. This cross-sectional form permits a sufficiently stable construction of the pendulum bridge to be obtained with a minimum quantity of high-grade synthetic resin. Preferably the connecting rail 58 of the pendulum bridge is also of gable-like construction in cross-section, at least in its end regions. The limbs 60, 62 with the feet 64, 66 formed thereon engage positively in a respective recess 108 provided in the outside of the cover plate, whereby the assembly position of the pendulum bridge is perfectly defined in relation to the pendulum shaft 22. The bearing bore 110 of the pendulum bridge receiving the pendulum shaft 22 is regionally conically enlarged outwardly, such as may be seen at 112. The enlargement of the bore serves for receiving oil when the bearing of the pendulum shaft is to be lubricated from time to time.

In a known manner, sound slots 114 which are disposed parallel to each other and which preferably (as shown) extend parallel to the pendulum bridge 30 are located below the pendulum bridge. As may be seen from FIG. 3, these slots 114 are covered on the inside of the cover plate by rails 116 which are directed obliquely upwardly and rearwardly, so that the ingress of dust into the casing is rendered difficult thereby.

Directly below the pendulum shaft 22 and below the second outlet slots 114, the cover plate 12 is provided with a recess 118 whose contour corresponds substantially to that of the finger plate of the winding key 48, so that the key is positively insertable in this recess and its shank 48' projects into the interior of the casing. The finger plate projects slightly above the front surface of the cover plate, and in the rest position of the pendulum 24 (in which the pendulum is retained by a projection 120 formed on the upper end of the cover plate), the balancing weight 36 of the pendulum rests against the finger plate of the winding key 48 and secures the key against dropping out of the recess 118.

Preferably, the scale plate 92 has a trapezoidal or trapezium-shaped contour and is disposed on the cover plate in such a manner that its width decreases slightly in the upward direction. The contour of the cover plate 12 as well as that of the main portion 10 of the casing is matched to the contour of the scale plate 92, i.e. these parts also decrease in width slightly in the upward direction. The scale plate 92 terminates just above the pendulum bridge 30, the cover plate 12 and the main portion 10 of the casing decreasing in width downwardly from this region onwards, whereby the metronome casing is a particularly handy and aesthetic shape.

Figure 3:
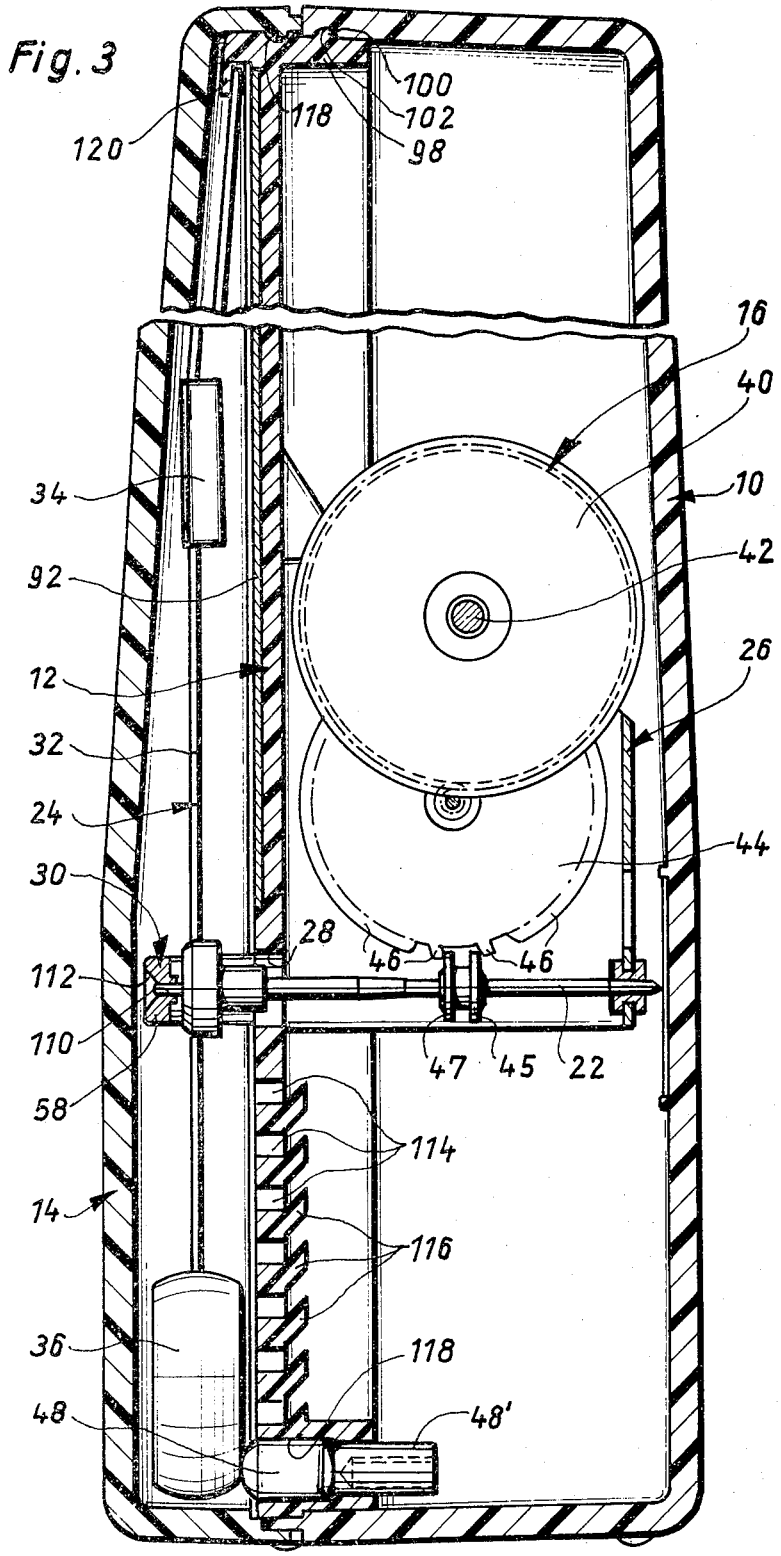
FIG. 3 is a longitudinal section on line 3—3 of FIG. 1, on an enlarged scale, with parts omitted for the sake of clarity.

As illustrated in FIG. 3, the cover plate 12 projects forward beyond the front face of the main portion 10 of the casing and the lid 14 can be positively placed on the projecting portion of the cover plate, the lid 14 being engageable at 118 with the upper part of the cover plate.

We claim:

1. A metronome, comprising (a) an elongate trough-like casing (10) including three side walls, a bottom wall and a top wall, said walls being arranged to define a chamber;

(b) a front cover plate (12) connected with said casing for closing said chamber;

(c) pendulum driving means (16,26) arranged within said chamber;

(d) a horizontal U-shaped pendulum bridge (30) extending transversely across said cover plate adjacent the front surface thereof;

(e) a pair of spaced threaded devices (68) for simultaneously connecting both said bridge and said pendulum driving means in contiguous engagement with the front and rear surfaces of said cover plate, respectively;

(f) a horizontal pendulum shaft (22) rotatably supported at one end by said bridge, said pendulum shaft extending rearwardly through an opening (28) contained in said cover plate and being rotatably supported at its outer end, said pendulum shaft being connected for driven movement by said driving means;

(g) a vertical pendulum (24) non-rotatably mounted intermediate its ends on said shaft between said bridge and said cover plate;

(h) a vertical imprinted scale plate (92) mounted on the outer surface of said cover plate adjacent said pendulum; and (i) holder means (74, 76) on the inside surface of said cover plate for engaging an edge portion of said pendulum driving means, said holder means cooperating with said pair of threaded devices to securely retain said driving means against the rear surface of said cover plate.

2. A metronome, comprising (a) an elongate trough-like casing (10) including three side walls, a bottom wall and a top wall, said walls being arranged to define a chamber;

(b) a front cover plate (12) connected with said casing for closing said chamber;

(c) pendulum driving means arranged within said chamber, said driving means including (1) a generally U-shaped frame (26) including a horizontal transverse portion parallel with and spaced from the rear surface of said cover plate, and a pair of horizontal limb portions (50,52) extending forwardly toward said cover plate, said limb portions terminating at their free ends in crank edge portions (54,56) adjacent the rear surface of said cover plate; and (2) pendulum drive motor means (16) mounted on said frame;

(d) a horizontal U-shaped pendulum bridge (30) extending transversely across said cover plate adjacent the front surface thereof;

(e) at least two threaded devices (68) for rigidly connecting said bridge and said pendulum driving means in contiguous engagement with the front and rear surfaces of said cover plate, respectively, said threaded devices extending through aligned openings contained in said bridge, said cover plate and said crank edge portions, respectively, the openings in said crank edge portions being threaded for engagement by said threaded devices, respectively;

(f) a horizontal pendulum shaft (22) rotatably supported at one end by said bridge, said pendulum shaft extending rearwardly through an opening (28) contained in said cover plate and being rotatably supported at its other end, said pendulum shaft being connected for driven movement by said drive motor means;

(g) a vertical pendulum (24) non-rotatably mounted intermediate its ends on said shaft between said bridge and said cover plate;

(h) a vertical imprinted scale plate (92) mounted on the outer surface of said cover plate adjacent said pendulum; and (i) holder means (74) arranged on the inside of said cover plate at a location spaced from and threaded devices for cooperating with said threaded devices to connect said frame with the rear surface of said cover plate.

3. A metronome as claimed in claim 2, in which a recess is arranged in said crank edge portion between the screw-threaded opening and the holder means, and a pin is provided on the inside of the cover plate which engages in the recess.

4. A metronome as claimed in claim 2 or 3, in which the holder means is in the form of a rail having a lip-like projection which engages substantially without play over the corresponding crank edge portion.

5. A metronome as claimed in claim 4, in which each cranked edge portion is in engagement at its end remote from the screw-threaded opening between two abutments on the inside of the cover plate, and further wherein the lip-like projection extends between the abutments and engages over the said end of the crank edge portion.

6. A metronome, comprising (a) an elongate trough-like casing (10) including three side walls, a bottom wall and a top wall, said walls being arranged to define a chamber;

(b) a front cover plate (12) connected with said casing for closing said chamber, said cover plate including a recess (108);

(c) pendulum driving means (16,26) arranged within said chamber;

(d) a horizontal U-shaped pendulum bridge (30) extending transversely across said cover plate adjacent the front surface thereof, said bridge including projection feet (64, 66) which positively engage said cover plate recess, said bridge further including a bearing bore (110) conically enlarged at the front edge thereof, said bridge terminating at a spacing from the front end of said conically enlarged bearing bore;

(e) a pair of spaced threaded devices (68) for simultaneously connecting both said bridge and said pendulum driving means in contiguous engagement with the front and rear surfaces of said cover plate, respectively;

(f) a horizontal pendulum shaft (22) rotatably mounted at one end in said bridge bearing bore, said pendulum shaft extending rearwardly through an opening (28) contained in said cover plate and being rotatably supported at its other end, said pendulum shaft being connected for driven movement by said driving means;

(g) a vertical pendulum (24) non-rotatably mounted intermediate its ends on said shaft between said bridge and said cover plate;

(h) a vertical imprinted scale plate (92) mounted on the outer surface of said cover plate adjacent said pendulum; and (i) holder means (74, 76) on the inside surface of said cover plate for engaging an edge portion of said pendulum driving means, said holder means cooperating with said pair of threaded devices to securely retain said driving means against the rear surface of said cover plate.

7. A metronome as claimed in claim 2 or 6, in which the scale plate is of substantially trapezoid shape and tapers inwardly in the upward direction.

8. A metronome as claimed in claim 7, in which the cover plate and the casing decrease in width upwardly above the bridge.

9. A metronome as claimed in the claim 8, in which the cover plate and the casing decrease in width downwardly below the bridge.

10. A metronome as defined in claim 2 or 6, wherein said bridge includes feet projection portions, and further wherein said cover plate includes a recess for positively receiving said bridge feet projection portions.

11. A metronome as defined in claim 10, wherein said bridge is a molded member of synthetic resin material.

12. A metronome as defined in claim 11, wherein said bridge includes limb portions having a substantially right-angled triangle cross-section, the triangle apices defined by the right-angles being located opposite each other.

13. A metronome as defined in claim 2 or 6, and further comprising means for fixing said cover plate to said casing including (1) a pair of apertures in said cover plate aligned with and laterally spaced from said pair of bridge connecting threaded devices; and (2) a second pair of threaded devices (94) adapted to be received by said cover plate apertures.

14. A metronome as defined in claim 13, wherein one of said cover plate and said casing includes a peripheral collar (98) for positively mutually engaging the other of said cover plate and said casing, and further including detent means (100) for locking said cover plate to said casing.

15. A metronome as defined in claim 14, wherein said cover plate includes sound outlet slots arranged between said bridge and said insert opening.

16. A metronome as defined in claim 15, and further including rails which cover said sound outlet slots on the inside of said cover plate, said rails being directed obliquely upwardly and rearwardly.

17. A metronome as defined in claim 2 or 6, wherein said cover plate includes an insert opening spaced directly below said pendulum shaft for receiving a winding key.

18. A metronome as defined in claim 17, wherein said pendulum includes a second lower balance weight 36 which covers said insert opening when the pendulum is in a central rest position.

* * * * *